United States Patent [19]

Johns

[11] 4,239,159

[45] Dec. 16, 1980

[54] PRODUCTION OF FINE METAL POWDERS

[75] Inventor: Dereck R. Johns, Hillsborough, England

[73] Assignee: Air Products and Chemicals, Inc., Allentown, Pa.

[21] Appl. No.: 11,749

[22] Filed: Feb. 13, 1979

[30] Foreign Application Priority Data

Feb. 13, 1978 [GB] United Kingdom ..... 5612/78

[51] Int. Cl.[3] ..... B02C 23/24

[52] U.S. Cl. ..... 241/23; 241/29; 241/DIG. 37

[58] Field of Search ..... 241/23, 29, 30, 39, 241/65, 153, 152 R, 152 A, 154, DIG. 37

[56] References Cited

U.S. PATENT DOCUMENTS

| | | | |
|---|---|---|---|
| 4,015,780 | 4/1977 | Hall | 241/DIG. 37 |
| 4,018,633 | 4/1977 | Holland | 241/DIG. 37 |

*Primary Examiner*—Mark Rosenbaum

*Attorney, Agent, or Firm*—E. Eugene Innis; James C. Simmons

[57] ABSTRACT

Metal particles which are ductile at ambient temperature can be comminuted by being passed through a first impact mill at ambient temperature to increase their length to thickness ratio, embrittled, and then comminuted in a second impact mill.

3 Claims, 1 Drawing Figure

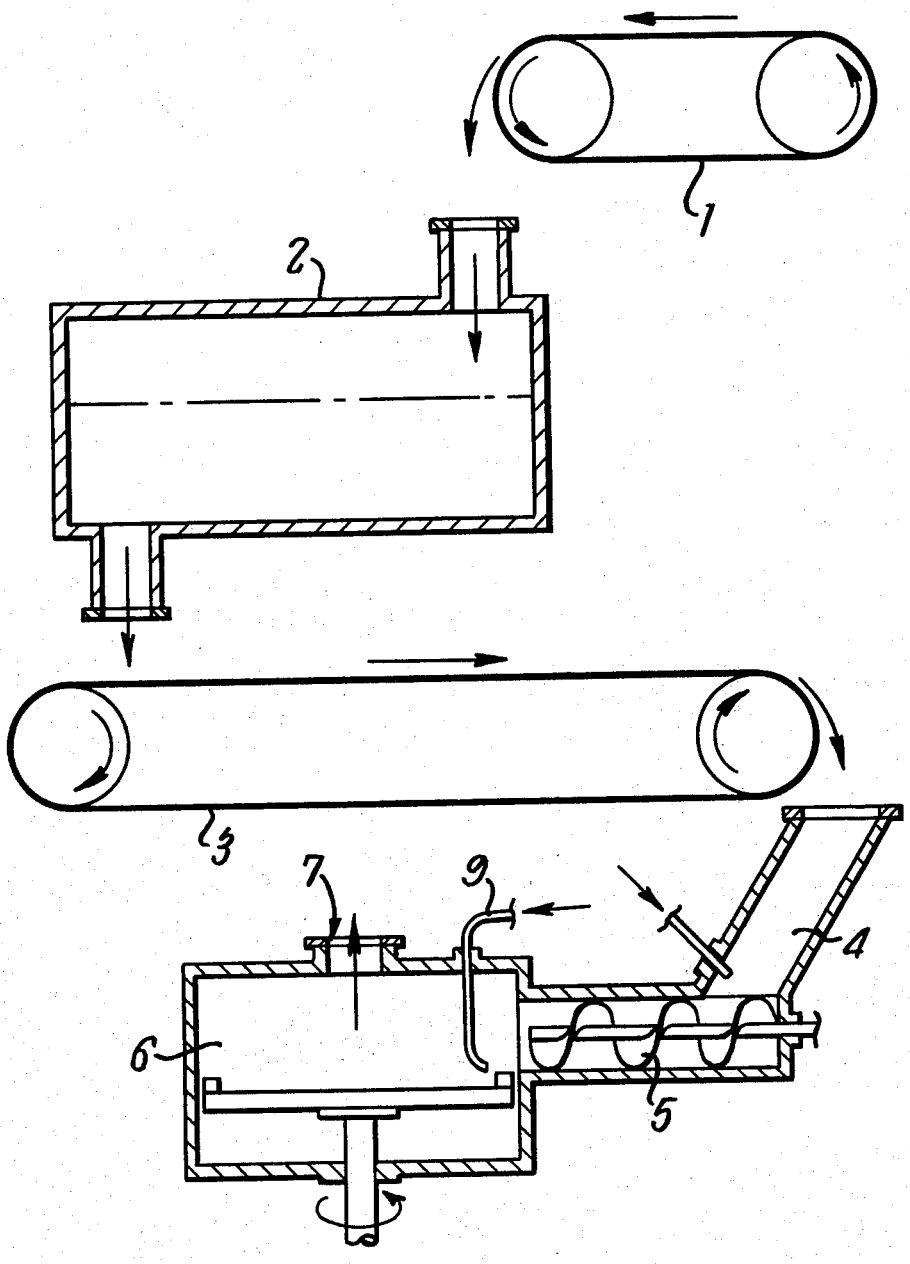
1
2
3
4
5
6
7
9

PRODUCTION OF FINE METAL POWDERS

This invention relates to the production of fine metal powders especially ferrous powders by cryogenic comminution of oversize powder particles.

Conventional techniques of producing metal powders, for example gas and water-atomisation, tend to produce in the powders particles having a broad range of different sizes. When setting out to produce relatively fine powders, therefore, those particles which are oversize have either to be returned to the melting furnace for reprocessing or reduced in size by a grinding or milling operation. Comminution of metal powders which are malleable at ambient temperatures cannot readily be achieved by grinding or milling because they tend to flatten rather than fragment. Furthermore, metal powders produced by gas or water-atomisation techniques tend generally to be of a shape which hinders fragmentation at other than very low cryogenic temperatures.

According to the present invention in one aspect there is provided a method of comminuting oversize ductile metal powder particles comprising the steps of impacting the particles to increase their length to thickness ratio, cooling the impacted particles to embrittlement and comminuting the embrittled particles to produce relatively fine powder. By the term 'ductile metal powder particles' is meant particles which are malleable at ambient temperatures and which undergo a ductile to brittle transformation at temperatures below ambient. Examples of such particles include ferrous powders consisting of iron, mild steel, low carbon steels, and ferritic stainless steels.

Preferably, the ductile metal powder particles are impacted within a vibratory ball mill to produce length to thickness ratios in excess of 10:1.

Advantageously, the impacted particles are cooled to below their embrittlement temperature and then comminuted in a rotary impact mill, typically at a temperature below −40° C. The coolant employed during precooling and embrittlement may be liquid nitrogen.

According to the present invention in another aspect there is provided apparatus for comminuting ductile metal powder particles including first impaction means operable to increase the length to thickness ratios of the particles at ambient temperatures or at temperatures above ambient and second impaction means operable to comminute the particles at a temperature below the embrittlement temperature of the particles.

Preferably, the first and/or second impaction means comprises a vibratory ball mill, a rod mill, a rotary impact mill, a fluid energy mill, a disc mill or a pin mill.

According to the present invntion in a further aspect there is provided fine metal powder produced by the method and apparatus referred to above.

The invention will now be described with reference to the accompanying diagrammatic drawing in which the sole FIGURE is a side elevational view partly in section of apparatus in accordance with the invention.

In the apparatus illustrated, ferrous powder which is malleable at ambient temperatures is conveyed by an endless conveyor belt 1 to a vibratory ball mill 2 within which it is impacted for a period of time sufficient to produce elongate flattened particles having relatively high length to thickness ratios.

Such particles are more susceptible to fragmention at cryogenic temperatures than powder particles produced by a conventional gas or water atomisation technique. Additionally, impaction work hardens the particles to increase their readiness to fragmentation and introduces micro-cracks thereby creating planes of fracture within the particles.

The impacted flattened particles are conveyed from the mill 2 by an endless belt 3 to a precooler 4 connected to receive liquid nitrogen from a source (not shown). The ferrous particles are lowered to a temperature of approximately −20° C. within the precooler and are then conveyed by a screw feeder 5 to a rotary impact mill 6 also connected to the aforementioned source of liquid nitrogen. The particles are lowered to a temperature of approximately −100° C. within the mill 6 by the liquid nitrogen and then comminuted within the mill to fine powder.

The comminuted fine powder particles leave the impact mill 6 in suspension in the nitrogen gas leaving the mill through an outlet port 7 and are collected within a classifier, oversize particles being returned to the impact mill 6. The nitrogen gas is then recirculated via re-processing units through ducting 9 either back to the rotary impact mill 6 or is collected for re-use elsewhere.

The invention will be further described with reference to the following two Examples, which compare a conventional cryogenic process for comminuting metal powder (Example 1) with a process in accordance with the invention (Example 2). For both Examples, the feedstock powder comprised a water-atomised low-carbon steel powder, having the following sieve analysis:

| Mesh Size (British Standard) | % Retained |
|---|---|
| 30 | 11.2 |
| 60 | 26.0 |
| 80 | 31.7 |
| 100 | 20.4 |
| 200 | 10.3 |
| 300 | 0.2 |
| 400 | 0.0 |
| below 400 | 0.2 |

EXAMPLE 1

A first batch of this powder was ground at a temperature of approximately −100° C. in a rotary impact mill; this gave a maximum throughput of 55 Kg per hour and a product with the following sieve analysis.

| Mesh Size | % Retained |
|---|---|
| 30 | 4.1 |
| 60 | 16.9 |
| 80 | 25.5 |
| 100 | 21.5 |
| 200 | 28.7 |
| 300 | 2.5 |
| 400 | 0.5 |
| below 400 | 0.2 |

Comparing the ground metal powder with the as-atomised powder it will be seen that the below 100 mesh size fraction of the powder was increased following cryogenic comminution from 10.7% to 31.9%. This represents a production rate for below 100 mesh size powder of 11.7 Kg per hour.

EXAMPLE 2

A second batch of the as-atomised powder was impacted within a ball mill to produce substantially flattened elongate particles; the impacted powder was found to have a sieve analysis of:

| Mesh Size | % Retained |
|---|---|
| 30 | 14.2 |
| 60 | 30.0 |
| 80 | 35.1 |
| 100 | 17.8 |
| 200 | 1.7 |
| 300 | 0.5 |
| 400 | 0.6 |
| below 400 | — |

When comparing this sieve analysis with that of the as-atomised powder, it will be appreciated that a considerable coarsening of the powder has occurred with the below 100 mesh size fraction being reduced to 2.8%.

The impacted powder was then ground at a temperature of approximately −100° C. within a rotary mill under the same conditions as those used in Example 1; this produced a throughput in excess of 200 Kg per hour with a product having the following sieve analysis:

| Mesh Size | % Retained |
|---|---|
| 30 | 5.0 |
| 60 | 21.3 |
| 80 | 24.4 |
| 100 | 20.1 |
| 200 | 28.3 |
| 300 | 0.8 |
| 400 | 0.1 |
| below 400 | — |

A comparison of the sieve analysis of the as-atomised powder with that produced in the second cryogenic grinding stage shows that the below 100 mesh fraction has increased from 10.7% to 29.2%. This respresents a below 100 mesh production rate of 37 Kg per hour, that is to say a three-fold increase in efficiency.

What is claimed is:

1. A method of comminuting oversize ductile metal powder particles produced by water or gas atomization comprising the steps of impacting the particles to increase their length to thickness ratio thus producing generally elongated flattened particles, cooling the elongated particles to a temperature at which the elongated particles become embrittled and further comminuting the embrittled particles to produce relatively fine powder.

2. A method according to claim 1, wherein the ductile metal powder particles are impacted within a vibratory ball mill to produce length to thickness ratios in excess of 10.1.

3. A method according to claim 1 or 2, wherein said impacted particles are cooled to below their embrittlement temperature and then comminuted in a rotary impact mill.

* * * * *